US009708817B2

(12) United States Patent
Gestetner

(10) Patent No.: US 9,708,817 B2
(45) Date of Patent: Jul. 18, 2017

(54) WALL COVERING

(71) Applicant: Tubav Ventures Corp., Spring Valley, NY (US)

(72) Inventor: Shraga Gestetner, Monsey, NY (US)

(73) Assignee: Tubav Ventures Corp., Spring Valley, NY (US)

( * ) Notice: Subject to any disclaimer, the term of this patent is extended or adjusted under 35 U.S.C. 154(b) by 30 days.

(21) Appl. No.: 14/824,295

(22) Filed: Aug. 12, 2015

(65) Prior Publication Data

US 2017/0044772 A1 Feb. 16, 2017

(51) Int. Cl.

| | |
|---|---|
| ***E04B 2/30*** | (2006.01) |
| ***E04F 13/08*** | (2006.01) |
| ***E04B 1/86*** | (2006.01) |

(52) U.S. Cl.

CPC ..... *E04F 13/081* (2013.01); *E04B 1/86* (2013.01); *E04F 13/083* (2013.01)

(58) Field of Classification Search

CPC .... E04F 13/081; E04B 1/40; E04B 2001/405; F16M 13/02

USPC ..... 52/235, 36.1, 36.5, 239, 241, 463, 468, 52/483.1, 489.2

See application file for complete search history.

(56) References Cited

U.S. PATENT DOCUMENTS 2,066,205 A * 12/1936 Keating ..... E04B 9/068 52/370
2,097,988 A * 11/1937 Ross ..... E04B 1/24 24/696
2,278,822 A * 4/1942 Benz ..... E04F 13/0803 52/480
3,188,774 A * 6/1965 McCorkle ..... E04F 13/0803 52/478
3,342,000 A * 9/1967 Cripe ..... E04B 1/76 293/155
3,521,419 A * 7/1970 Fornells ..... E04B 9/26 52/386
3,671,061 A * 6/1972 Dawdy ..... E04F 13/0812 411/30
3,753,325 A * 8/1973 Stanley ..... E04B 2/78 52/481.2
3,849,954 A * 11/1974 Sugita ..... E04F 13/0803 52/235

(Continued)

OTHER PUBLICATIONS

Fas-Paks,The Hillman Group, Cincinnati, OH, Aug. 11, 2015.

(Continued)

*Primary Examiner* — Basil Katcheves
*Assistant Examiner* — Joshua Ihezie
(74) *Attorney, Agent, or Firm* — Weiss & Arons LLP

(57) ABSTRACT

Apparatus and methods for providing wall covering. The apparatus may include a traveling support for a wall covering panel. The support may include a bracket. The bracket may include a projection that extends into a generally U- or C-shaped channel. The apparatus may include one or more standards for each panel. The apparatus may include one or more brackets for each panel for each standard. The bracket or brackets may be arranged so that when the panel is engaged to the standard or standards, the standards are parallel to each other and perpendicular to an edge of the panel. The standard or standards and the panel will thus be squared. When the edge is set on a horizontal floor, the standard or standards will be plumb.

19 Claims, 10 Drawing Sheets

(56) References Cited

U.S. PATENT DOCUMENTS 3,998,018 A * 12/1976 Hodges ..... E04B 2/789 52/363
4,646,506 A * 3/1987 Slapsys ..... E04B 9/363 52/460
5,044,971 A 9/1991 Hollingsworth
5,349,802 A * 9/1994 Kariniemi ..... E04F 13/0812 52/478
5,996,299 A * 12/1999 Hsueh ..... E04B 2/7863 52/479
6,419,436 B1 7/2002 Gaudron
6,430,885 B1 * 8/2002 Ito ..... E04F 13/0812 52/235
7,040,350 B2 5/2006 Young
7,992,673 B2 * 8/2011 Petrie ..... H04R 1/02 181/141
8,997,436 B2 * 4/2015 Spear ..... E04F 13/0894 52/239
9,309,677 B1 * 4/2016 Anic ..... E04F 13/0814
9,328,518 B2 * 5/2016 Bilge ..... E04F 13/0805
2002/0035811 A1 3/2002 Heuel
2006/0101744 A1 5/2006 Falbaum et al.
2006/0272187 A1 12/2006 Mervine
2007/0283656 A1 12/2007 Anderson
2010/0277808 A1 * 11/2010 Bowers ..... G02B 27/40 359/642
2011/0283632 A1 * 11/2011 Sutton ..... A47B 46/005 52/36.1
2013/0205702 A1 8/2013 D'Alessandro et al.

OTHER PUBLICATIONS

Grabberman.com, Highlard Park, Utah, Aug. 11, 2015.
Wall-Dog, Victoria, Australia, Aug. 11, 2015.
International Search Report for international Patent Application No. PCT/US2016/046688, Aug. 12, 2016.
Written Opinion of the International Searching Authority for International Patent Application No. PCT/US20161046688, Aug. 12, 2016.

* cited by examiner

WALL COVERING

BACKGROUND

Wall covering may provide aesthetic or acoustic properties to a wall, often in the interior of a building. In some instances, wall covering includes panels that are mounted on the wall to cover a region of the wall. The panels may be numerous and require alignment with features of the wall and with each other.

It would be desirable, therefore, to provide apparatus and methods for providing wall covering.

BRIEF DESCRIPTION OF THE DRAWINGS

The objects and advantages of the invention will be apparent upon consideration of the following detailed description, taken in conjunction with the accompanying drawings, in which like reference characters refer to like parts throughout, and in which.

DETAILED DESCRIPTION

Figure 1:
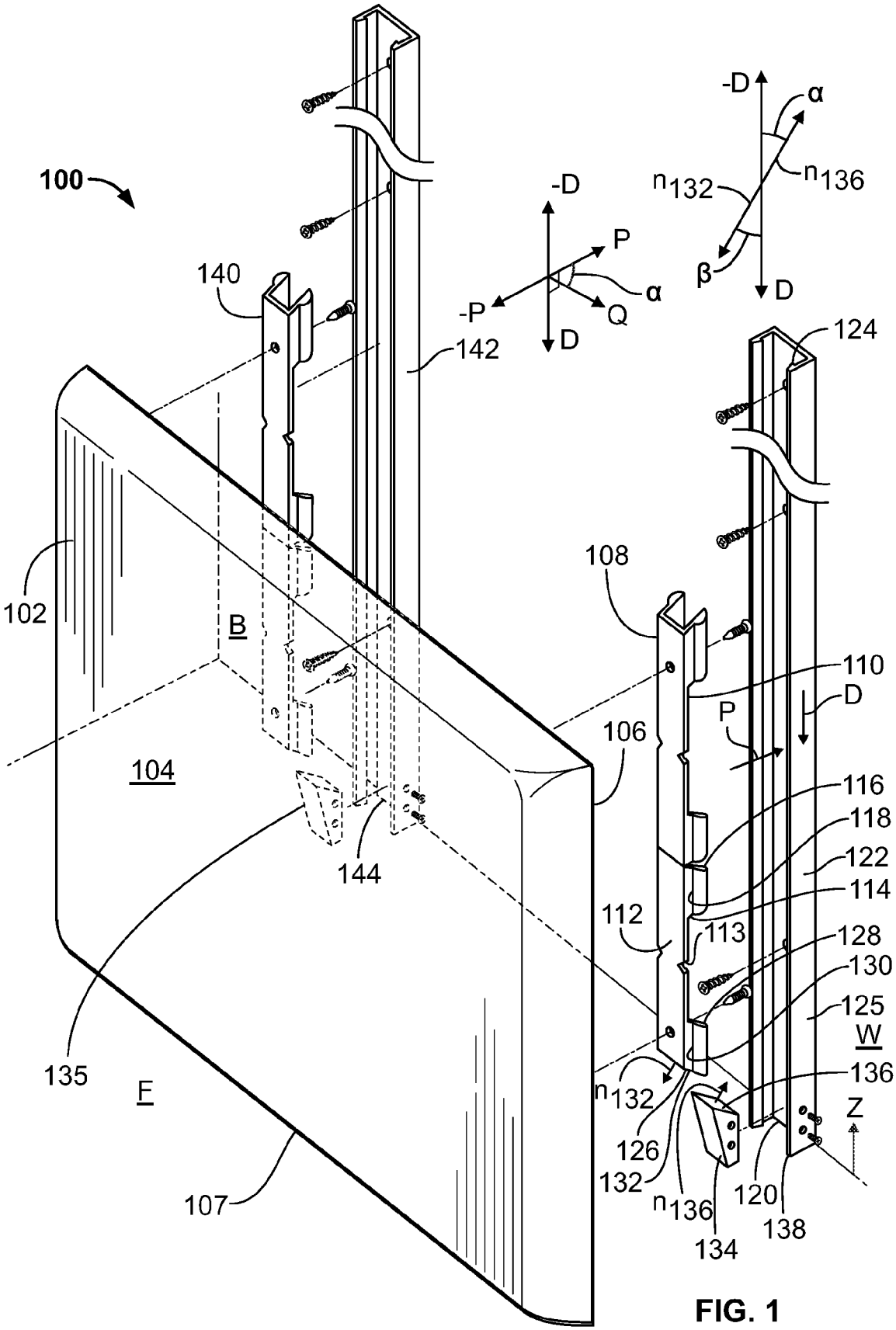
FIG. 1 is an exploded view of illustrative apparatus in accordance with the principles of the invention positioned relative to structure.

Apparatus and methods for providing wall covering are provided.

The apparatus may include a traveling support for a wall covering panel. The support may include a bracket. The bracket may include a panel mounting surface. The bracket may include a projection. The projection may extend from the bracket in a direction away from the panel mounting surface. The projection may include a surface that trends away from the direction to define a space in which to receive an elongated standard.

The standard may include a generally U- or C-shaped channel "iron." The standard may include an angle "iron." The standard may include a tube. The standard may be fastened to the wall by any suitable means. For example, a fastener may be passed through the standard into the wall. A clamp or strap may be wrapped about or through, or otherwise fixed to, the standard and then fastened to the wall.

The fastener may be a screw. The screw may be threaded for engaging sheet rock. The screw may be self-piloting. The screw may be self-drilling. The screw may be a screw such as that available under the trademark WALLDOG from The Hillman Group, Cincinnati, Ohio. The screw may have one or more of the features of fasteners shown and described in one or more of U.S. Pat. Nos. 6,419,436 and 7,040,850, both of which are hereby incorporated herein in their entireties.

The screw may be emplaced through the full depth of the wall. If the screw has a ¼" diameter and length 1¼ ", it may have a capacity to hold an axial (along the axis of the screw) force of 50-85 lbs. in ½" wallboard and 135 lbs. in ⅝" wallboard. Anchorless screws of other sizes may have corresponding capacities. Anchorless screws of this size or other sizes may have different capacities.

Each standard may include a clearance hole for each screw. Each standard may include less than 1, 1, 2, 3 or more clearance holes aligned between the bottom and top of each panel.

The apparatus may include one, two, three, four or more standards for each panel.

The apparatus may include one, two, three, four or more brackets for each panel for each standard.

The bracket or brackets may be arranged so that when the panel is engaged to the standard or standards, the standards are parallel to each other and perpendicular to an edge of the panel. The standard or standards and the panel will thus be squared. When the edge is set on a horizontal floor, the standard or standards will be plumb.

The bracket may include a canted member. The canted member may be inclined toward a plane that is defined by the mounting surface. In operation the canted member may extend downward from the bracket. The canted member may be configured to draw the panel mounting surface toward the elongated standard in response to motion of the bracket along the elongated standard.

The bracket may provide sliding engagement with the standard. The bracket may releasably engage the standard to stabilize the panel in a position at or near the side of the standard. The bracket may slide along the length of the standard while the panel is retained at or near the side of the standard. The bracket may be elongated in a direction aligned with the length of the standard to provide support against rotation of the panel in a plane parallel to the wall. Multiple brackets may be provided to act together to provide support against rotation of the panel in a plane parallel to the wall. A single bracket may be provided with multiple projections to act together to provide support against rotation of the panel in a plane parallel to the wall.

The bracket may be a bracket that is not elongated in a direction aligned with the length of the standard. For example, the bracket may have cylindrical symmetry. For example, the bracket may have the form of a bulb, a mushroom, a barb, or an arrowhead. Multiple such brackets may be arrayed in a direction aligned with the length of the standard to provide support against rotation of the panel in a plane parallel to the wall.

The projection may be a first projection. The surface may be a first surface. The direction may be a first direction. The space may be a first space. The apparatus may include, when the projection is a first projection, the surface is a first surface, the direction is a first direction and the space is a first space, a second projection. The second projection may extend from the bracket in a second direction away from the panel mounting surface. The second projection may include a second surface. The second surface may trend away from the second direction to define a second space in which to receive the elongated standard.

A projection may transversely, with respect to the standard, "catch" an interior feature of the standard by applying an outward directed force against an interior feature of the standard. A projection may transversely, with respect to the standard, "catch" an interior feature of the standard by applying inward directed force against an interior feature of the standard.

A projection may transversely, with respect to the standard, "catch" an exterior feature of a standard by applying an inward directed force against an exterior feature of the standard. A projection may transversely, with respect to the standard, "catch" an exterior feature of a standards by applying outward directed force against an exterior feature of the standard.

The first and second directions may converge away from the bracket.

The first and second directions diverge away from the bracket.

The first and second surfaces may trend toward each other away from the bracket.

The first and second directions surfaces may trend away from each other away from the bracket.

The first projection may be one of a plurality of first projections. Each one of the plurality of first projections may extend from the bracket in the first direction. Each one of the plurality of first projections may include a surface that is congruent with the first surface.

The second projection may be one of a plurality of second projections. Each one of the plurality of second projections may extend from the bracket in the second direction. Each one of the plurality of second projections may include a surface that is congruent with the second surface.

The surface may include a face. The face may include a tangent that operationally is oriented vertically and is slidable along the standard.

The face may be a first face. The apparatus may include, when the face is a first face, a second projection. The second projection may extend from the bracket in a second direction away from the panel mounting surface. The second surface may include the second face. The second face may have a tangent that operationally is oriented vertically and is slidable along the standard.

The first projection may be one of a plurality of first projections. Each of the plurality of first projections may extend from the bracket in the first direction. Each of the plurality of first projections may include a surface that is congruent with the first surface and a face that is congruent with the first face.

The second projection is one of a plurality of second projections. Each one of the plurality of second projections may extend from the bracket in the second direction. Each one of the plurality of second projections may include a surface that is congruent with the second surface and a face that is congruent with the second face.

The apparatus may include a brace. The brace may secure a bracket to a standard by preventing the projections from deflecting away from the standards. The brace may secure a bracket to a standard by pressing the surfaces against the standards. The brace may include metal, polymer, styrene, acrylic, polymer clay or any other suitable material.

The apparatus may include a wall covering panel. The panel may be configured to be affixed to the panel mounting surface. The wall covering panel may include a backing. The standard may have a sidewall that extends away from the wall when the standard is mounted on the wall. The sidewall may cause an offset between the wall and the backing. The offset may be a horizontal offset.

The panel may include a recess. The recess may be defined in a side of the panel that normally faces the wall and includes the backing. The bracket may be disposed in the recess. The standard, when engaged with the bracket, may be received in the recess. This may reduce or eliminate the offset. The panel may have a recess for each bracket.

The apparatus may include one or more electronic devices. The apparatus may include one or more electrical loads. The apparatus may include one or more conductor raceways. The standard may support the load and the raceway. The raceway may retain a power line for providing current to the load. The raceway may extend along all or some of the standard. The raceway may include one or more of an entrance port and an exit port for the conductor. The standard may include one or more of an entrance port and an exit port for the conductor. The raceway may be inside a channel in the standard. The raceway may be external to the standard.

The apparatus may include an electromagnetic emitter.

The panel may include a facing. The facing may be translucent relative to the backing. The panel may support the emitter between the backing and the facing. The panel may be one of a plurality of wall covering panels. The bracket may be one of a plurality of brackets. Each one of the brackets may have a panel mounting surface. Each of the panel mounting surfaces may correspond to one of the plurality of wall covering panels. The projection may be one of a plurality of congruent projections.

The emitter may emit a wavelength in the visible spectrum. The emitter may emit a wavelength greater than wavelengths in the visible spectrum. The emitter may emit a wavelength lesser than wavelengths in the visible spectrum.

The apparatus may include an acoustic transmitter. The facing may be acoustically permeable relative to the backing. The wall covering panel may support the acoustic transmitter between the backing and the facing.

The apparatus may include an acoustic receiver.

The wall covering panel may support the receiver between the backing and the facing.

The apparatus may include a radio frequency receiver.

The wall covering panel may support the acoustic receiver.

The apparatus may include a radio frequency transmitter.

The wall covering panel may support the radio frequency transmitter.

The wall covering panel may support the radio frequency receiver.

The apparatus may include an accessory panel. The apparatus may include an accessory panel mount. The accessory panel mount may have one or more features in common with the bracket. The mount may be configured to snap into the standard in a position adjacent a position of a wall covering panel such that the accessory panel and the wall covering panel are positioned contiguous with each other.

The accessory panel may include a video display.

The apparatus may include a camera. The wall covering panel may support the camera.

The wall covering panel may be one of a plurality of wall covering panels.

The first bracket may be one of a plurality of first brackets, each having a panel mounting surface that corresponds to one of the plurality of wall covering panels. The second bracket may be one of a plurality of second brackets, each having a panel mounting surface that corresponds to one of the plurality of wall covering panels. The first brackets may be congruent with each other. The second brackets may be congruent with each other. The first brackets may be congruent with the second brackets.

The first projection may be one of a plurality of first projections. The second projection may be one of a plurality of second projections. The first projections may be congruent with each other. The second projections may be congruent with each other. The first projections may be congruent with the second projections. The first projections may be mirror images of the second projections.

The first surface may be one of a plurality of first surfaces. The second surface may be one of a plurality of second surfaces. The first surfaces may be congruent with each other. The second surfaces may be congruent with each other. The first surfaces may be congruent with the second surfaces. The first surfaces may be mirror images of the second surfaces.

The first face may be one of a plurality of first faces. The second face may be one of a plurality of second faces. The first faces may be congruent with each other. The second faces may be congruent with each other. The first faces may be congruent with the second faces. The first faces may be mirror images of the second faces.

The apparatus may include wall treatment apparatus.

The wall treatment apparatus may include a first elongated standard. The wall treatment apparatus may include a second elongated standard. The wall treatment apparatus may include a wall covering panel. The wall treatment apparatus may include first supporting means for supporting the panel and, in a direction transverse to a longitudinal axis of the standard, engaging the first standard. The wall treatment apparatus may include second supporting means for supporting the panel and, in a direction transverse to a longitudinal axis of the standard, engaging the second standard. The first means and the second means may be arranged to retain the first standard and the second standard parallel to each other and against the wall when the wall covering panel is positioned at the wall and before either of the first and second standards is fastened to the wall.

The first means and the second means may be permanently arranged to retain the first standard and the second standard parallel to each other and against the wall when the wall covering panel is positioned at the wall and before either of the first and second standards is fastened to the wall.

The first means and the second means may be affixed to the panel during manufacture in a position that is not adjustable and is designed to retain the first standard and the second standard parallel to each other and against the wall when the wall covering panel is positioned at the wall and before either of the first and second standards is fastened to the wall.

The first means and the second means may be affixed to the panel during assembly in a position that is not adjustable and is designed to retain the first standard and the second standard parallel to each other and against the wall when the wall covering panel is positioned at the wall and before either of the first and second standards is fastened to the wall.

The apparatus may include first preventing means for preventing the first supporting means from sliding off of an end of the first standard. The apparatus may include second preventing means for preventing the second supporting means from sliding off of an end of the second standard. The first and second preventing means may be arranged such that when the panel is so positioned, the ends of the first and second standards are vertically even with each other.

The apparatus may include a plurality of wall covering panels. The apparatus may include a plurality of first supporting means. Each one of the plurality of first supporting means may support a corresponding one of the plurality of wall covering panels, engage the first standard in a direction transverse to a longitudinal axis of the first standard, and slide along the first standard parallel to the longitudinal axis while engaged with the first standard.

The apparatus may include a plurality of second supporting means. Each one of the plurality of second supporting means may support a corresponding one of the plurality of wall covering panels, engage the second standard in a direction transverse to a longitudinal axis of the second standard, and slide along the second standard parallel to the longitudinal axis while engaged with the second standard.

The apparatus may include one or more anchorless fasteners. Each of the fasteners may be configured to fasten the first standard and the second standard to the wall. The first supporting means may be configured to disengage from the first standard by displacement away from the wall. The fasteners may be present in sufficient number to retain the standards against the wall during the displacement. The fasteners include means for retaining the standards against the wall during the displacement. The means for retaining may include threads. The threads may be selected engage the wall more strongly than the supporting means engage the standards.

The methods may include a method for installing a wall covering.

The methods may include engaging a bracket, affixed to the panel, with an elongated standard. The method may include aligning a bottom edge of the panel with a base of a wall to orient the standard vertically along the wall. The method may include fastening the standard to the wall.

The methods may include, when the bracket is the first bracket and the panel is a first panel, after the fastening, engaging the second bracket, affixed to a second panel, with the elongated standard, and sliding the second panel toward the first panel.

The sliding may include sliding the second panel into contact with the first panel.

The methods may include fastening an elongated standard to a frangible wall; and engaging, in a direction transverse to the elongated standard, with the elongated standard a wall covering panel bracket, the bracket fixed to the panel. The fastening may include providing a tensile link between the standard and the wall. The tensile link may include one or more fasteners. In aggregate, the fasteners may have an ultimate tensile load capacity. The engaging may include providing resilient projections that extend from the bracket, engage the standard, and are in aggregate releasable from the standard by application to the panel of a transverse force that is less than the ultimate tensile load capacity.

The method may include engaging a first wall covering panel to the elongated standard; fastening the standard to a wall; engaging a second wall covering panel to the standard; and, using the standard and a gravitational force on the second panel, guiding a lower edge of the second panel to rest on an upper edge of the first panel.

The method may include stabilizing, against dislodgement transverse to the standard, the first panel by applying a gravitational body force of the second panel to the first panel. The gravitational force may generate a frictional force of the second panel upon the first panel. The frictional force may resist transverse displacement of the first panel from the standard. The frictional force may be increased by adding placing one or more additional panels, engaged with the standard, on top of the second panel.

The method may include compressing one or both of a top conformable margin of the first panel and a bottom conformable margin of the second panel using the gravitational body force of the second panel.

One or more of the panels may include an outline in a plane orthogonal to the plane of the panel. The outline may have a relaxed contour. The outline may have a stressed contour. The relaxed contour may be manifest before the panel is engaged in the standard. The stressed contour may be manifest when the panel is engaged in the standard and is allowed to deform under its own gravitational body force. The stressed contour may be manifest when the panel is engaged in the standard and is allowed to deform under its own gravitational body force in combination with a resistive force from an object below. The stressed contour may be manifest when the panel is engaged in the standard and is allowed to deform under its own gravitational body force in combination with a resistive force from an object below and gravitational body forces from one or more panels engaged in the standard above.

The top conformable margin may have a first relaxed contour; the bottom conformable margin has a second relaxed contour; and, prior to application of the gravitational body force, but after the first and second panels are slid into contact, the first and second contours may define a gap between the first and second panels.

The compressing may include using the gravitational body force to close the gap.

Engaging the second wall covering panel to the elongated standard may include releasably interlocking one or more resilient surfaces with the elongated standard, the surfaces in aggregate operationally retaining the second panel at the elongated standard and providing frictional resistance to being gravitationally drawn down the standard, the frictional resistance being less than a gravitational body force on the second panel.

The method may include engaging a plurality of brackets with the elongated standard, each bracket of the plurality of brackets being fixed to a corresponding one of a plurality of panels; and sliding each panel of the plurality of panels into contact with a previously engaged panel.

The method may include, when the elongated standard is a first elongated standard, engaging the second bracket with a second elongated standard, the second bracket fixed to the second panel; and fastening the second standard to the wall.

The aligning may include aligning the bottom edge of the first panel with a base of a wall to orient the second standard vertically along the wall.

The method may include engaging a plurality of brackets with each of the elongated standards, each bracket of the plurality of brackets being fixed to a corresponding one of a plurality of panels; and sliding each panel of the plurality of panels along the standards into contact with a previously engaged panel.

The engaging may include snapping the bracket to a lateral aspect of the standard. The snapping may include inserting an insert into a recess in the standard. The snapping may include inserting the projection into a recess in the standard. Inserting may include inserting the bracket into a longitudinal channel in the standard.

The engaging may including sliding the bracket along the standard until the bracket meets a detent. The sliding may include positioning an end of the standard at the bottom edge. The sliding may include interlocking the bracket and the detent. The sliding may include releasably interlocking the bracket and the detent.

The aligning may include placing the panel on a floor near a base of the wall without the use of a levelling instrument.

The fastening may include driving an anchorless fastener through the standard and into the wall.

The driving may include driving the fastener through a hole in the standard.

Table 1 lists illustrative materials for selected apparatus.

TABLE 1

Illustrative materials for selected apparatus.

| Selective apparatus | Illustrative material |
|---|---|
| Facing | Non-woven fabric |
| | Woven fabric |
| | Textile |
| | Polyester |
| | Polyvinylchloride |
| | Acrylonitrile Butadien Stylene |
| | Leather |
| | PU leather |
| | Bicast leather |
| | Reconstituted leather |
| | Bonded leather |
| | Polyurethane |
| | Glass |
| | Frosted glass |
| | Architectural glass |
| | Mirror glass |
| | Metal |
| | Wood |
| | Polymer |
| | Fiber |
| | Carbon fiber |
| | Any other suitable material |
| Backing | Non-woven fabric |
| | Woven fabric |
| | Textile |
| | Polyester |
| | Polyvinylchloride |
| | Acrylonitrile Butadien Stylene |
| | Leather |
| | PU leather |
| | Bicast leather |
| | Reconstituted leather |
| | Bonded leather |
| | Polyurethane |
| | Glass |
| | Frosted glass |
| | Architectural glass |
| | Mirror glass |
| | Metal |
| | Wood |
| | Polymer |
| | Fiber |
| | Carbon fiber |
| | Any other suitable material |
| Panel interior | Foam |
| | Bating |
| | Padding |
| | Wood |
| | Wood particles |
| | Metal |
| | Polymer |
| | Polyester |
| | Fiber |
| | Any other suitable material |
| Bracket | Metal |
| | Polymer |
| | Polyethylene |
| | Polypropylene |
| | Polytetrafluoroethylene |
| | Fiber |
| | Carbon fiber |
| | Any other suitable material |

TABLE 1-continued

Illustrative materials for selected apparatus.

| Selective apparatus | Illustrative material |
|---|---|
| Detent | Metal |
| | Polymer |
| | Polyethylene |
| | Polypropylene |
| | Polytrifluoroethylene |
| | Fiber |
| | Carbon fiber |
| | Any other suitable material |
| Standard | Metal |
| | Polymer |
| | Fiber |
| | Carbon fiber |
| | Any other suitable material |
| Brace | Polyester |
| | Polyvinylchloride |
| | Acrylonitrile Butadien Stylene |
| | Polyurethane |
| | Glass |
| | Frosted glass |
| | Metal |
| | Wood |
| | Polymer |
| | Fiber |
| | Carbon fiber |
| | Any other suitable material |
| Fastener (bracket to panel) | Screw |
| | Anchorless screw |
| | Molly bolt |
| | Toggle bolt |
| | Sheet rock screw |
| | Wood screw |
| | Cement screw |
| | Sheet metal screw |
| | Any other suitable fastener |
| Fastener (standard to wall) | Screw |
| | Anchorless screw |
| | Molly bolt |
| | Toggle bolt |
| | Sheet rock screw |
| | Wood screw |
| | Cement screw |
| | Sheet metal screw |
| | Any other suitable fastener |

Apparatus and methods in accordance with the invention will now be described in connection with the Figures. The features are illustrated in the context of selected embodiments. Apparatus and methods of the invention may involve some or all of the features of the illustrative apparatus and/or some or all of the steps of the illustrative methods. It will be understood that features shown in connection with one of the embodiments may be practiced together with features shown in connection with others of the embodiments. The steps of the methods may be performed in an order other than the order shown and described herein. Some embodiments may omit steps shown and described in connection with the illustrative methods. Some embodiments may include steps that are not shown and described in connection with the illustrative methods.

FIG. 1 shows illustrative wall covering apparatus 100 positioned on floor F near base B of wall W. Apparatus 100 may be installed on wall W at the illustrated position. Apparatus 100 may be installed on wall W at any suitable elevation z from floor F. For example, apparatus 100 may be installed at a desired height Z above floor F. If wall W includes or is provided with a ledge or molding, apparatus 100 may be installed by positioning apparatus 100 on top of or at a desired height above the ledge or molding. Wall W may be vertical. Wall W may be inclined toward floor F. Wall W may be inclined away from floor F. Apparatus 100 may be installed on a ceiling. "Down" direction D is defined with respect to apparatus 100, so "down" has meaning even when apparatus 100 is installed on a ceiling.

Apparatus 100 may include wall covering panel 102. Wall covering panel 102 may include facing 104. Wall covering panel 102 may include backing 106. Wall covering panel 102 may include an interior between facing 104 and backing 106. The interior may include batting, foam, fiber or any other suitable fill. The fill may be suitable for acoustic insulation. The fill may be suitable for echo reduction.

The panel may include a backing that supports a body that is engineered for acoustic performance. The body may have a surface with an acoustically selected texture. The body may have an acoustically selected microstructure. The microstructure may include interconnected passageways or cells. The microstructure may include unconnected passageways or cells. The microstructure may include gel. The microstructure may include composite material. The body may include laminated materials. The body may include lamina of different materials.

Panel 102 may be affixed to bracket 108. Bracket 108 may include plate 110. Plate 110 may include or be adapted for use with any suitable mounting features, such as screws, staples, nails, anchors, adhesives, rivets or any other suitable features, for mounting plate 110 to panel 102. For example, plate 110 may include mounting holes (not shown) for receiving fasteners, such as screws, that may be driven into backing 106. Plate 110 may include panel mounting surface 112. Panel mounting surface 112 may abut backing 106.

Bracket 108 may be disposed partially interior panel 102. One or both of projections 114 and 126 may extend through backing 106. An interior side of backing 106 may be fastened using any suitable fastener, such as one or more of those mentioned herein, to plate 110 surface 113, opposite panel mounting surface 112.

Projections such as projection 114 may extend away (in direction P) from plate 110. Projection 114 may include surface 116. Surface 116 may trend away from direction P. For example, surface 116 may trend along direction Q, at angle $\alpha$ to direction P. Direction Q may be oblique to direction P. Direction Q may be generally transverse to plate 110. Surface 116 may include face 118. Face 118 may have a surface normal that has a component in direction −P.

Projection 114 may extend into receptacle 120 of standard 122. One or both of surface 116 and face 118 may engage boss 124 of standard 122. Boss 124 may extend longitudinally along standard 122. Boss 124 may extend interior to channel 120 from sidewall 125. Boss 124 may include a lip. Boss 124 may include any suitable structure for engaging projection 114.

Projection 114 may resiliently deform to provide leeway for surface 116 to deflect around boss 124. Surface 116 may "snap" into receptacle 120. Surface 116 may lodge behind lip 116. When lodged, surface 116 may horizontally retain panel 102. Surface 116 may be slidable along boss 124 so that panel 102 may move or be moved in directions D and −D along standard 122. Projection 114 may be releasable from standard 122 by pulling panel 102 generally in direction −P.

Standard 122 may be affixed to wall W. Standard 122 may include or be adapted for use with any suitable mounting features, such as screws, staples, nails, anchors, adhesives, rivets or any other suitable features, for standard 122 to wall W. For example, standard 122 may include mounting holes (not shown) for receiving fasteners, such as screws, that may be driven into wall W.

Projections such as projection 126 may extend away (in direction P) from plate 110. Projection 126 may include surface 128. Surface 128 may trend away from direction P. For example, surface 128 may trend along direction Q, at angle α to direction P. Direction Q may be oblique to direction P. Direction Q may be generally transverse to plate 110. Surface 128 may include face 130. Face 130 may have a surface normal that has a component in direction −P.

Projection 126 may extend into receptacle 120 of standard 122. One or both of surface 128 and face 130 may engage boss 124 of standard 122. Projection 126 may resiliently deform to provide leeway for surface 128 to deflect around boss 124. Surface 128 may "snap" into receptacle 120. Surface 128 may lodge behind lip 128. When lodged, surface 128 may horizontally retain panel 102. Surface 128 may be slidable along boss 124 so that panel 102 may move or be moved in directions D and −D along standard 122. Projection 126 may be releasable from standard 122 by pulling panel 102 generally in direction −P.

Bracket 108, when engaged with standard 122, may slide along standard 122 in directions D and −D. One or both of faces 118 and 130 may have sufficient lubricity to glide along boss 124. Edge 138 of standard 122 may have sufficient lubricity relative to backing 106 of panel 102 to glide along backing 106. One or both of faces 118 and 130 may provide support against displacement of panel 102 in direction −P. Edge 138 may provide support against displacement of panel 102 in direction P.

Bracket 108 may include surface 132, having a surface normal $n_{132}$ that defines an orientation of surface 132. Surface 132 may be included in projection 126 as an edge of projection 126. Surface 132 may be inclined relative to plate 110. Surface 132 may be inclined relative to mounting surface 112. Surface normal $n_{132}$ may be inclined relative to direction D at angle β. Surface 132 may be straight, curved, segmented or have any other suitable form. Surface 132 may include any other suitable canted member.

Angle β may be in the following ranges: 0-5°, 5-10°, 10-15°, 15-20°, 20-25°, 25-30°, 30-35°, 35-40°, 40-45°, 45-50°, 50-55°, 55-60°, 60-65°, 65-70°, 70-75°, 75-80°, 80-85° and 85-90°.

When bracket 108 has the general form of a mushroom, a bulb, barb, or arrowhead, it may include a surface having one or more of the features of surface 132.

Apparatus 100 may include detent 134. Detent 134 may be disposed in channel 120. Detent 134 may span across channel 120. Detent 134 may include surface 136, having a surface normal $n_{136}$ that defines an orientation of surface 136.

Surface normal $n_{136}$ may be inclined relative to direction −D at angle γ. Surface 136 may be straight, curved, segmented or have any other suitable form. Surface 136 may include any other suitable canted member.

Surface 136 may be arranged so that surfaces 132 and 136 come into flush contact.

After bracket 108 engages standard 122, panel 102 may be displaced in direction D so that surface 132 contacts surface 136.

When β is 0°, surface 132 may come to rest at detent 134. When β is 0°, bracket 108 may be in a state in which it is not urged in direction P or direction −P by detent 134. When β is 0°, γ may be 0°.

When β is 90°, surface 132 is parallel to direction D. In such a case, surface 132 may be included in a lug or pin that extends in direction D. The lug or pin may be received by a complementary receptacle in detent 134. When β is 90°, γ may be 90°.

When β is oblique and positive than 0°, detent 134 may wedge bracket 108 toward standard 122. This may "snug" panel 102 against standard 122. When β is oblique and positive, γ may be commensurate with β.

When β is oblique and negative, detent 134 may wedge bracket 108 away from standard 122. This may "snug" one or both of faces 118 and 130 against boss 124. When β is oblique and negative, γ may be commensurate with β.

Bracket 140 may have one or more features in common with bracket 108. Bracket 140 may be positioned on backing 106 in a manner similar to the manner in which bracket 108 is positioned on backing 106. Bracket 140 may be spaced apart from bracket 108. Bracket 140 and bracket 108 may be arranged parallel to each other. One or both of brackets 140 and 108 may be arranged transverse to bottom edge 107 of panel 102. Standard 142 may have one or more features in common with standard 122. Channel 144 may have one or more features in common with channel 120. Bracket 140 may engage standard 142 in a manner that is similar to the manner in which bracket 108 engages standard 122.

When one or both of brackets 140 and 108 are arranged transverse to bottom edge 107, alignment of bottom edge 107 on floor F of base B may cause standards 142 and 122 to align vertically against wall W. Other panels, with corresponding brackets, can then be snapped into the standards and slid into contact with panel 102.

Detent 135 may have one or more features in common with bracket 134. Detent 135 may be positioned in standard 142 in a manner similar to the manner in which detent 134 is positioned in standard 122. Detent 135 may interact with bracket 140 in a manner similar to the manner in which detent 134 interacts with bracket 108.

Figure 2:
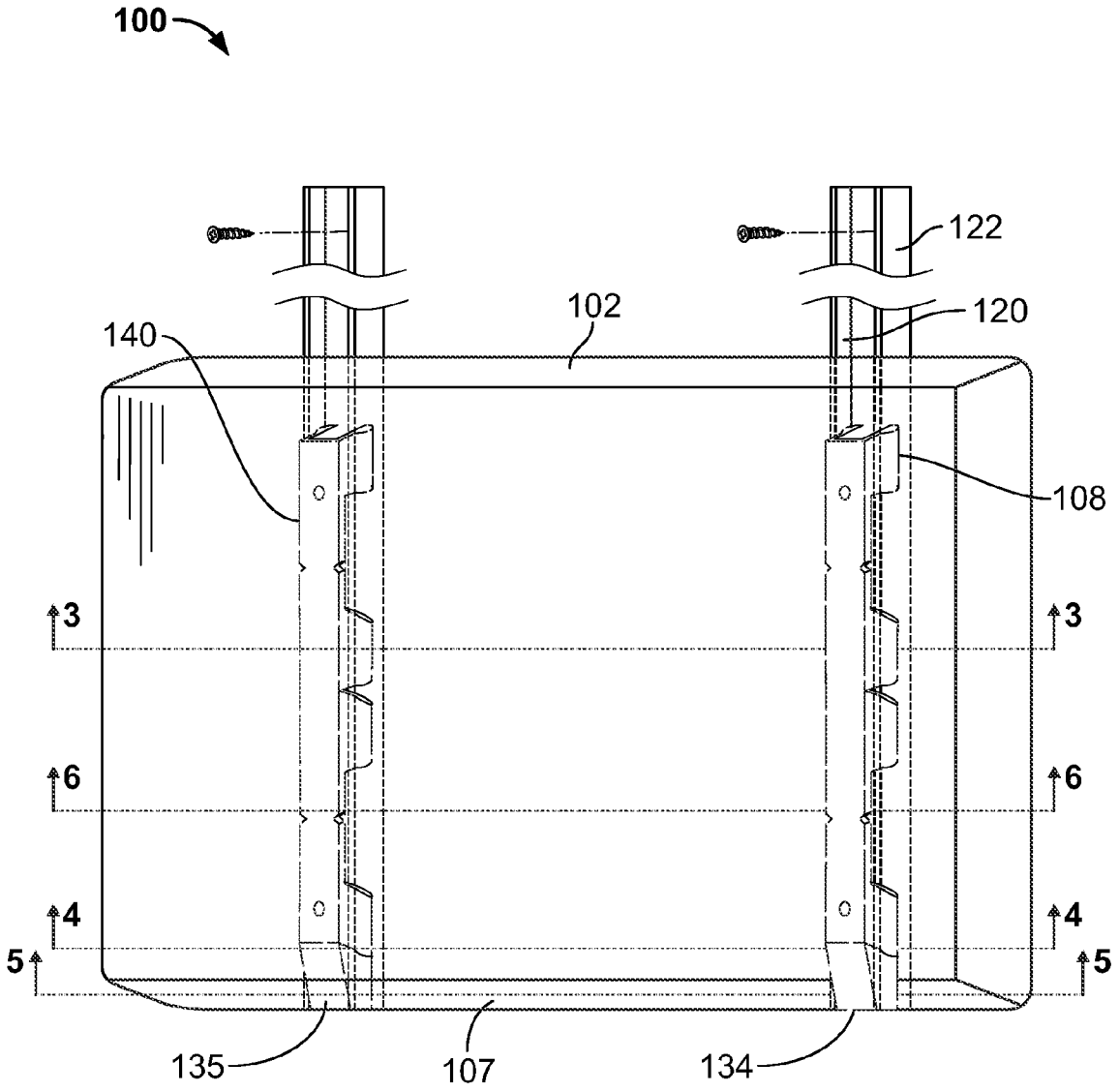
FIG. 2 is a partially exploded, partial cutaway view of the apparatus of FIG. 1 with parts partially assembled.

FIG. 2 shows illustrative apparatus 100 with panel 102 interlocked with standards 120 and 142 via, respectively, brackets 108 and 140. Detents 134 and 135 prevent panel 102 from sliding off the lower ends of the standards. The brackets and detents may be vertically placed relative to panel 102 such that bottom edge 107 is flush with, or at a predetermined height z away from, floor F (shown in FIG. 1). Standards 122 and 142 may rest on floor F when panel 102 is retained by the detents. Standards 122 and 142 may have ends that are flush with floor F when panel 102 is retained by the detents. Standards 122 and 142 may thus be retained upright and parallel to each other and generally parallel to wall W (shown in FIG. 1) prior to fastening the standards to wall W. This may facilitate the placement of fasteners through holes that may be provided in the standards.

Figure 3:
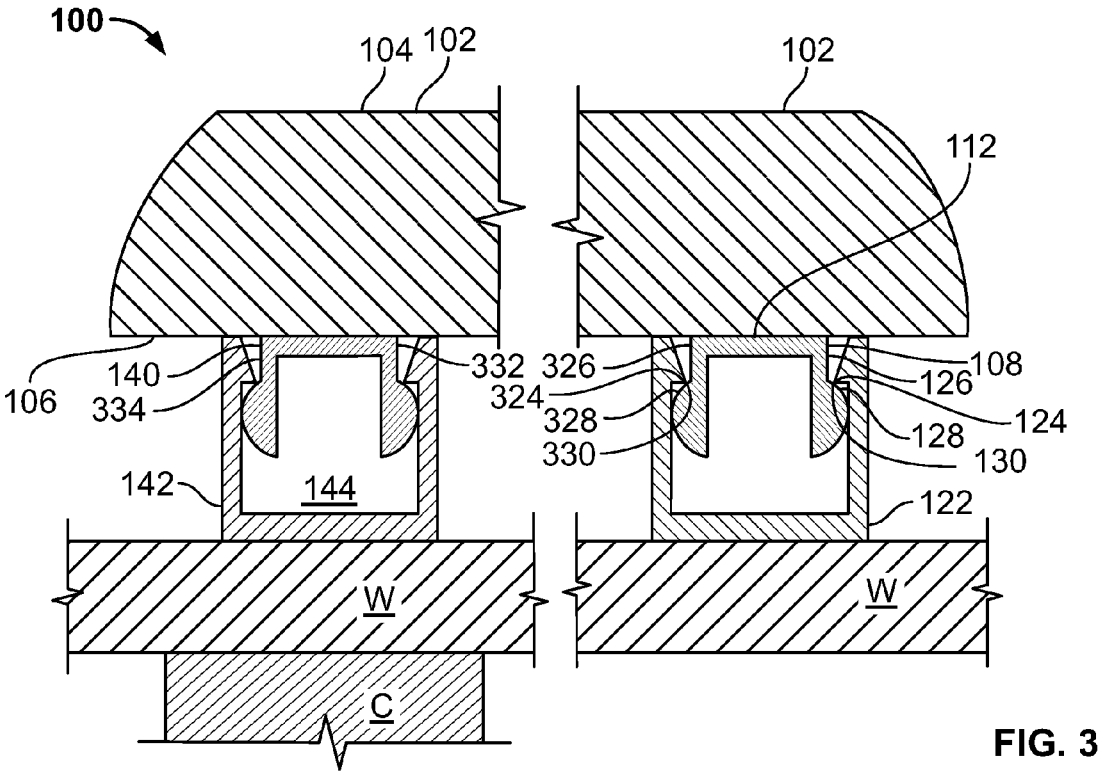
FIG. 3 is an illustrative cross-sectional view taken along line 3-3 (shown in FIG. 2).

FIG. 3 shows bracket 108 affixed at bracket mounting surface 112 to backing 106. Surface 116 may be supported by projection 114 from bracket 108. Projection 114 may extend from bracket 108 in direction P (shown in FIG. 1). Surface 116 may extend away from direction P to create a space in which to engage standard 122. Surface 116 may include face 118 that is tangent boss 124. Surface 118 may resist disengagement of bracket 108 from standard 122.

Bracket 108 may include projection 314. Projection 314 may have one or more features in common with projection 114. Projection 314 may include surface 328. Surface 328 may have one or more features in common with surface 128. Surface 328 may include face 330. Face 330 may have one or more features in common with face 130.

Projection 326 may be opposite projection 126 with respect to direction D (shown in FIG. 1). Projection 326 may be offset from projection 126 with respect to direction D. Bracket 108 may include one, two, three, four or more projections such as 126. Bracket 108 may include one, two, three, four or more projections such as 326.

Standard 122 is shown affixed to wall W. Standard 122 may include boss 324. Surface 328 may interact with boss 324 in the manner in which surface 128 interacts with boss 124.

Bracket 140 may include projection 332. Bracket 140 may include projection 334. Projection 332 may have one or more features in common with projection 126. Projection 334 may have one or more features in common with projection 326.

Bracket 140 may interact with panel 102 in the manner that bracket 108 interacts with panel 102. Bracket 140 may interact with standard 142 in the manner in which bracket 108 interacts with standard 122. Bracket 140 may extend into channel 144 in the manner in which bracket 108 extends into channel 120.

Wall W may include fiberboard, oriented strand board, gypsum, wallboard, plasterboard, wood, metal, mortar, masonry, stone, a frangible material or any other suitable material.

Wall W may be non-structural. Wall W may be structural.

Column C may include fiberboard, oriented strand board, gypsum, wallboard, plasterboard, wood, metal, mortar, masonry, stone or any other suitable material.

Column C may be non-structural. Column C may be structural. Column C may support wall W. Column C may be a stud. Column C may include a stud. Column C may include a joist.

Figure 4:
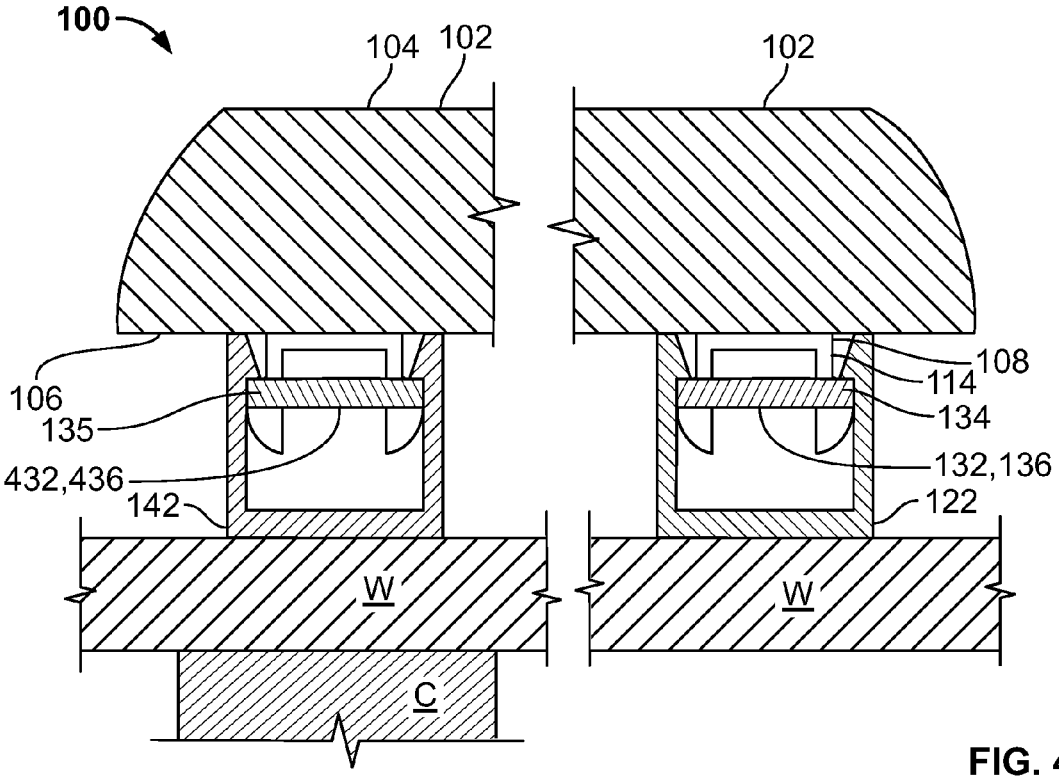
FIG. 4 is an illustrative partial cross-sectional view taken along line 4-4 (shown in FIG. 2).

FIG. 4 shows detents 134 and 135 interacting with brackets 108 and 140, respectively. Surface 132 of bracket 108 is in contact with surface 136 of detent 134. Surface 432 (of bracket 140 and corresponding to surface 132) is in contact with surface 436 (of bracket 140 and corresponding to surface 136). If brackets 108 and 140 are urged or drawn in direction D (shown in FIG. 1), the interactions of surface 132 with surface 136 and surface 432 with surface 436 urge or draw, in direction P (shown in FIG. 1) panel 102 toward standards 122 and 142. Surface 432 may have one or more feature in common with surface 132. Surface 436 may have one or more feature in common with surface 136.

Figure 5:
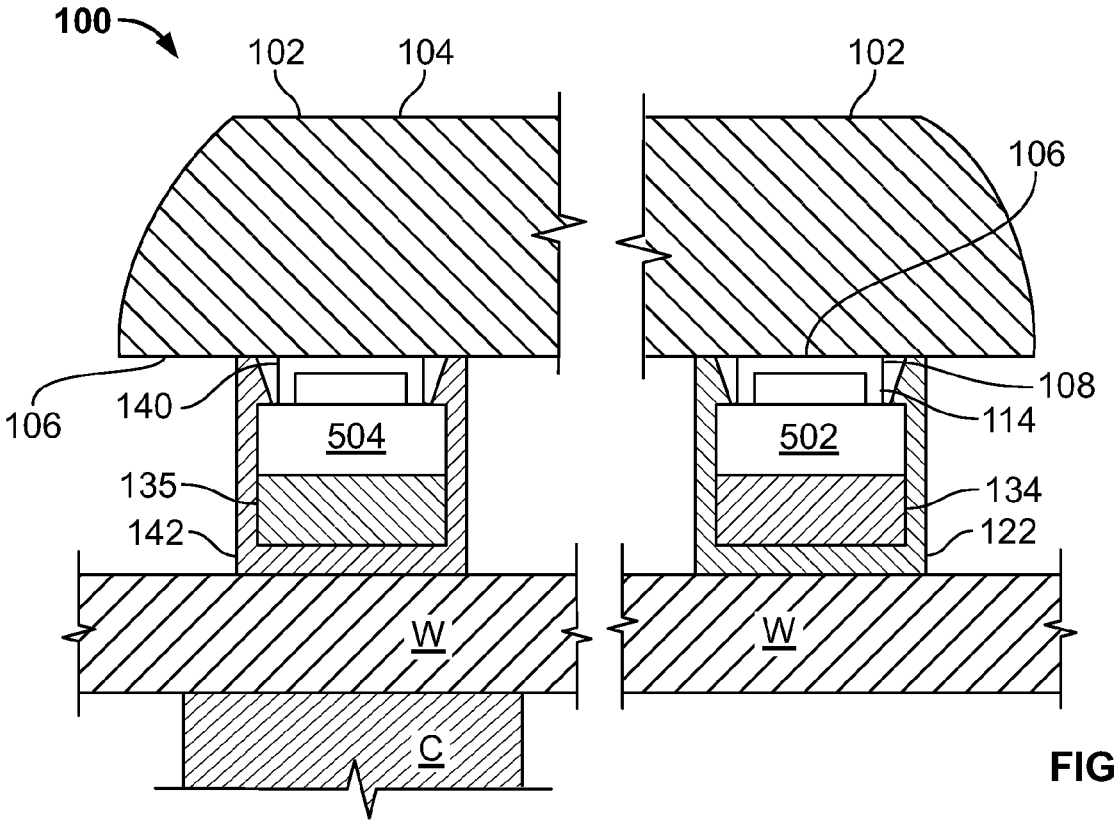
FIG. 5 is an illustrative partial cross-sectional view taken along line 5-5 (shown in FIG. 2).

FIG. 5. shows detent 134 below canted surface 132 (shown in FIG. 1). Detent 134 is illustrated as having a surface 502 that is sloped relative to direction D (shown in FIG. 1). Surface 502 may be curved. Surface 502 may be aligned substantially parallel to direction D. Detent 135 is illustrated as having a surface 504 that is sloped relative to direction D (shown in FIG. 1). Surface 504 may be curved. Surface 504 may be aligned substantially parallel to direction D.

Figure 6:
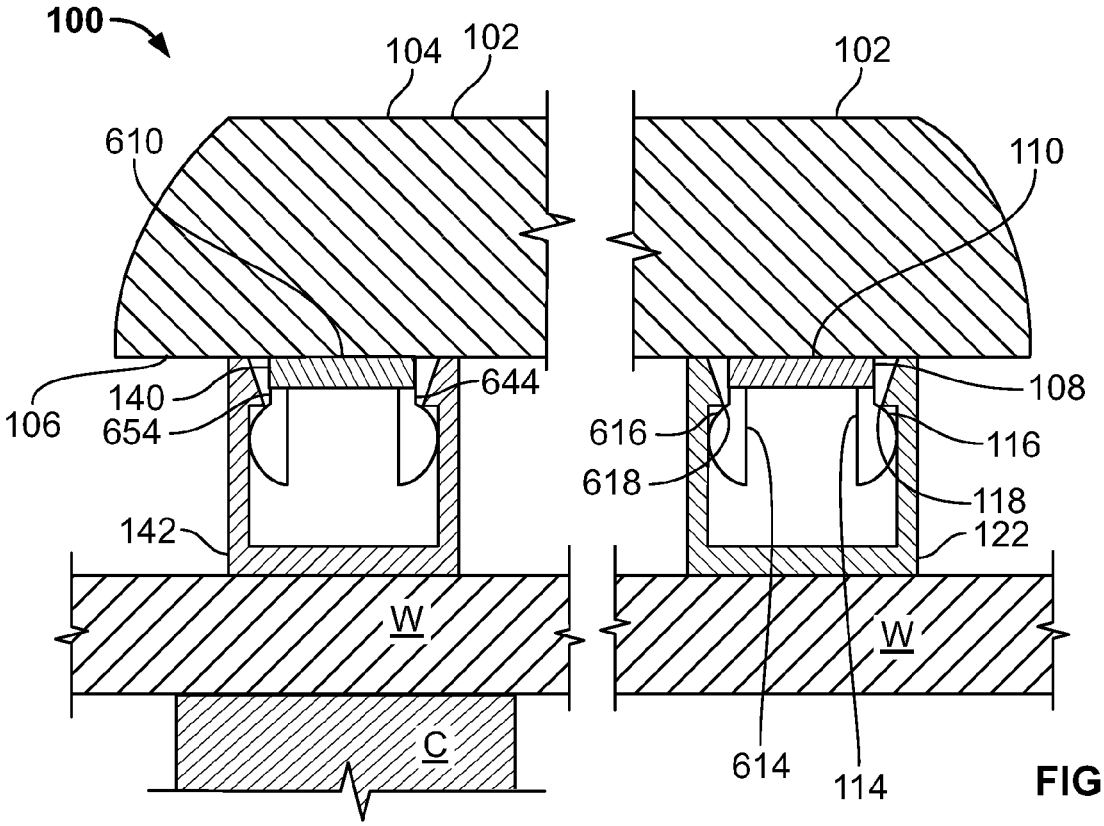
FIG. 6 is an illustrative partial cross-sectional view taken along line 6-6 (shown in FIG. 2).

FIG. 6 shows in cross section plate 110 of bracket 108 and plate 610 of bracket 140. Projections 114, 116, 644 and 654 are shown in the background. Projections 644 and 654 may have one or more features in common with projections 114 and 116.

Figure 7:
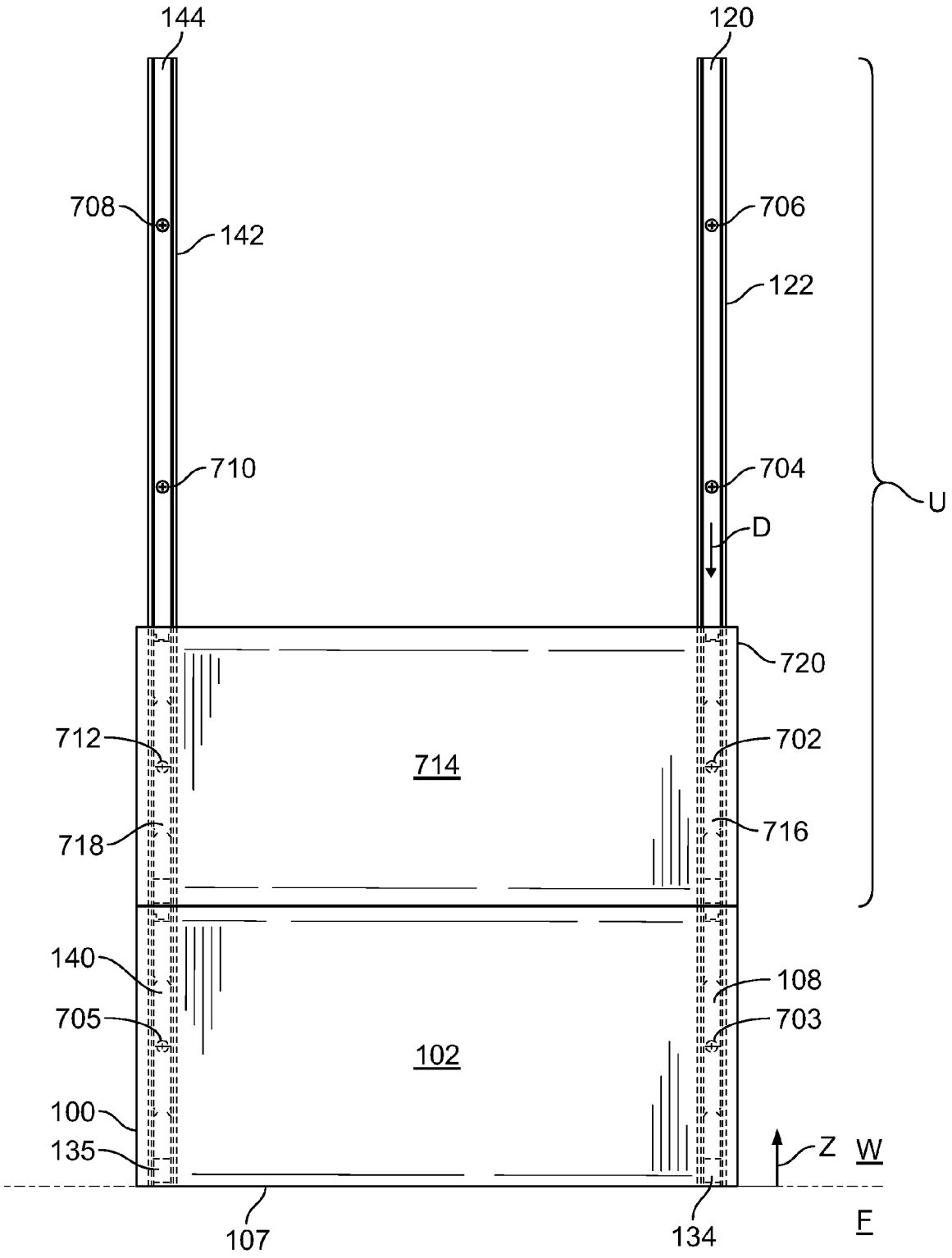
FIG. 7 shows the apparatus shown in FIG. 1 along with other apparatus in accordance with the principles of the invention.

FIG. 7 shows apparatus 100 affixed to wall W by illustrative fasteners 702, 703, 704, 705, 706, 708, 710 and 712. Holes for passage of the fasteners may be provided in standards 122 and 142. One or more of the holes may be pre-drilled. One or more of the holes may provide clearance gauged to the type of fastener to be used.

One or more of illustrative fasteners may have features in common with each other. Bottom edge 107 of panel 102 may by flush with floor F. Bottom edge 107 may be suspended above floor F a distance z by detents 134 and 135. Illustrative panel 714 may be retained near or against standards 122 and 142 by brackets 716 and 718. Panel 702 may have one or more feature in common with panel 102. Brackets 716 and 718 may have one or more features in common with brackets 108 and 140. One or both of brackets 716 and 718 may be brackets that do not have a canted surface such as surface 132 (shown in FIG. 1) or any other canted surface. One or both of brackets 716 and 718 may be brackets that include a terminal surface, in a location corresponding to the location of surface 132, that is perpendicular to backing 720 of panel 714. One or both of brackets 716 and 718 may be brackets that include a terminal surface, in a location corresponding to the location of surface 132, that is oblique to backing 720 of panel 714 and has a surface normal that has a component in direction P (shown in FIG. 1).

Brackets 716 and 718, while affixed to panel 714, may be inserted into channels 120 and 144, respectively. Brackets 716 and 718 may be inserted, in direction P (shown in FIG. 1), into channels 120 and 144, respectively. Direction P may be "transverse" to standards 122 and 142. Brackets 716 and 718 may be releasably engaged with standards 122 and 142 by transverse insertion into channels 120 and 144. Direction −P may be "transverse" to standards 122 and 142. Brackets 716 and 718 may be disengaged from standards 122 and 142 by transverse extraction from channels 120 and 144. A user may transversely insert or transversely extract the brackets from the channels by pushing panel 714 in direction P or pulling panel 714 in direction −P.

Brackets 716 and 718 may engaged with standards 122 and 142 in upper section U of standards 122 and 142.

Brackets 716 and 718 may be slid or allowed to slide under gravity or a driving force (source not shown) in direction D until panel 714 is in contact with panel 102. Brackets 716 and 718 may have surfaces (not shown) having one or more features in common with surface 116 (shown in FIG. 1) to guide panel 714 along standards 122 and 142 in direction D. Brackets 716 and 718 may be slid or allowed to slide under gravity or a driving force (source not shown) in direction −D. The weight of panel 714 upon panel 102 may cause one or both of detents 134 and 135 to draw panel 102 closer to standards 122 and 142, respectively.

Brackets 716 and 718 may be inserted, in direction D (shown in FIG. 1), into channels 120 and 144, respectively, at the tops of standards 122 and 142, respectively.

Figure 8:
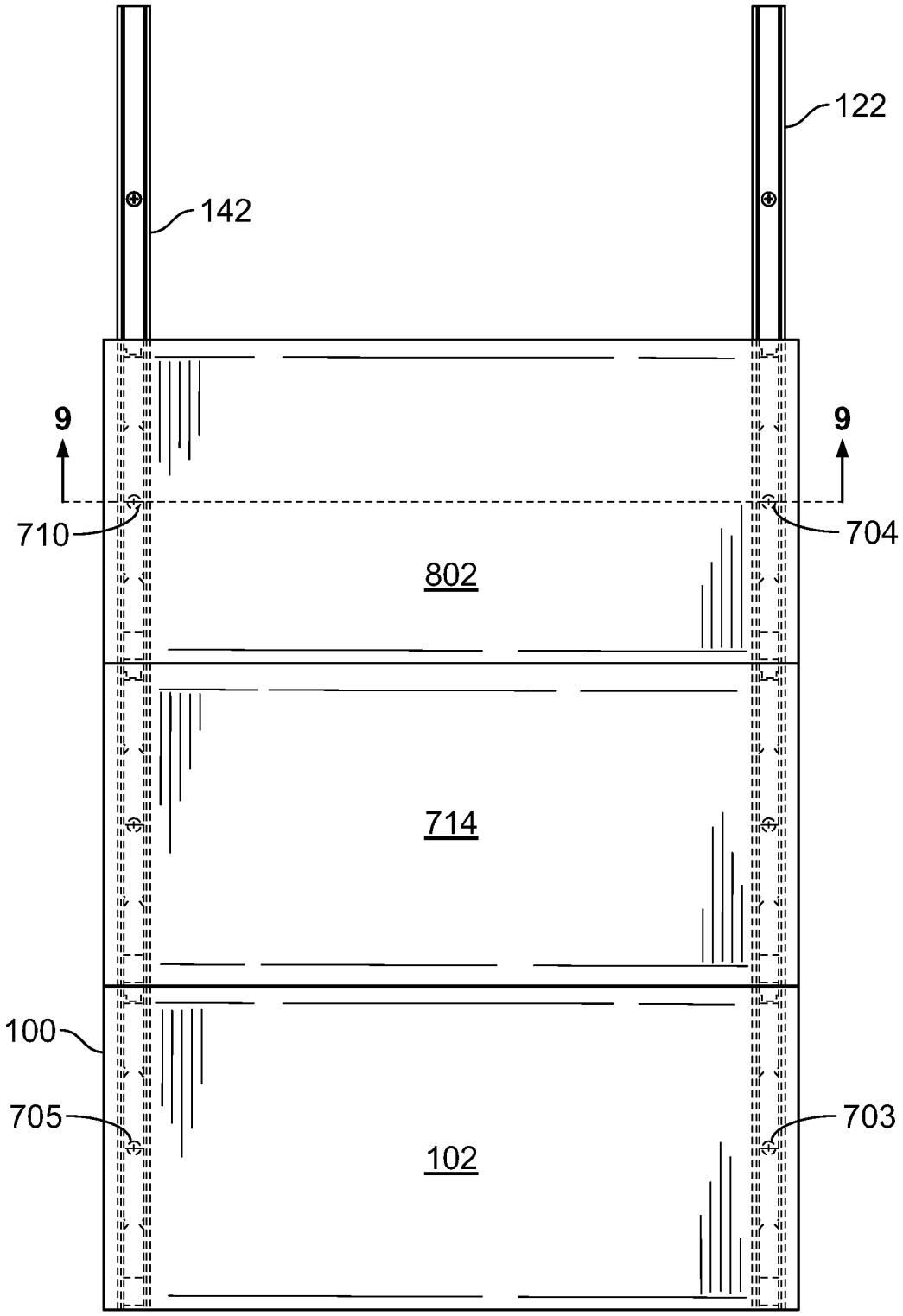
FIG. 8 shows the apparatus shown in FIG. 7 along with other apparatus in accordance with the principles of the invention.

FIG. 8 shows illustrative panel 802 engaged with standards 122 and 142 and resting on panel 714. Panel 802 may have one or more features in common with panel 714.

Figure 9:
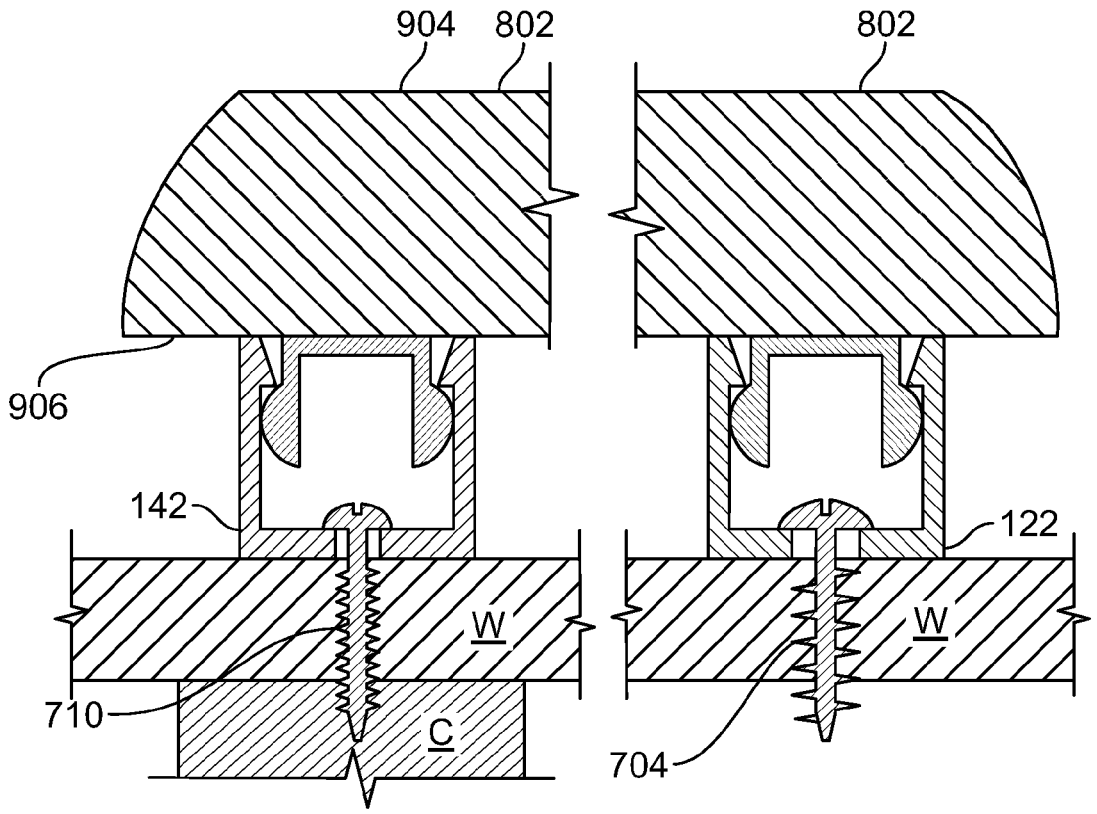
FIG. 9 is an illustrative cross-sectional view taken along line 9-9 (shown in FIG. 8).

FIG. 9 shows illustrative fastener 704 fixing standard 122 to wall W. Wall W may be non-structural. Fastener 704 may be an anchorless screw. Fastener 704 may include an anchor. The anchor may be a molly anchor. The anchor may be a toggle anchor. One or both of standards 122 and 142 may include a clearance hole that is gauged appropriately for the fastener. Illustrative fastener 710 may fix standard 122 to wall 704 by engaging column C. Column C may be structural. Fastener 710 may be a wood screw, a drywall screw, a lag screw or any other suitable type of fastener.

Column C may or may not be present behind wall W. Both of standards 122 and 142 may be mounted to wall W in the absence of column C or without engaging column C. When wall W is a non-structural wall, the standards may be mounted exclusively to wall W. One or more of fasteners 702, 703, 704, 705, 706, 708, 710 and 712 may be an anchorless fastener. The engagement of the fasteners with wall W may be sufficiently strong to retain the mounting of the standards under a panel-disengaging force in direction −P (shown in FIG. 1).

One or both of fasteners 703 and 705 may be applied to standards 122 and 142, respectively, by sliding panel 102 up (in the −D) direction. This may be done after one or both of standards 122 and 142 are fixed to wall W.

Figure 10:
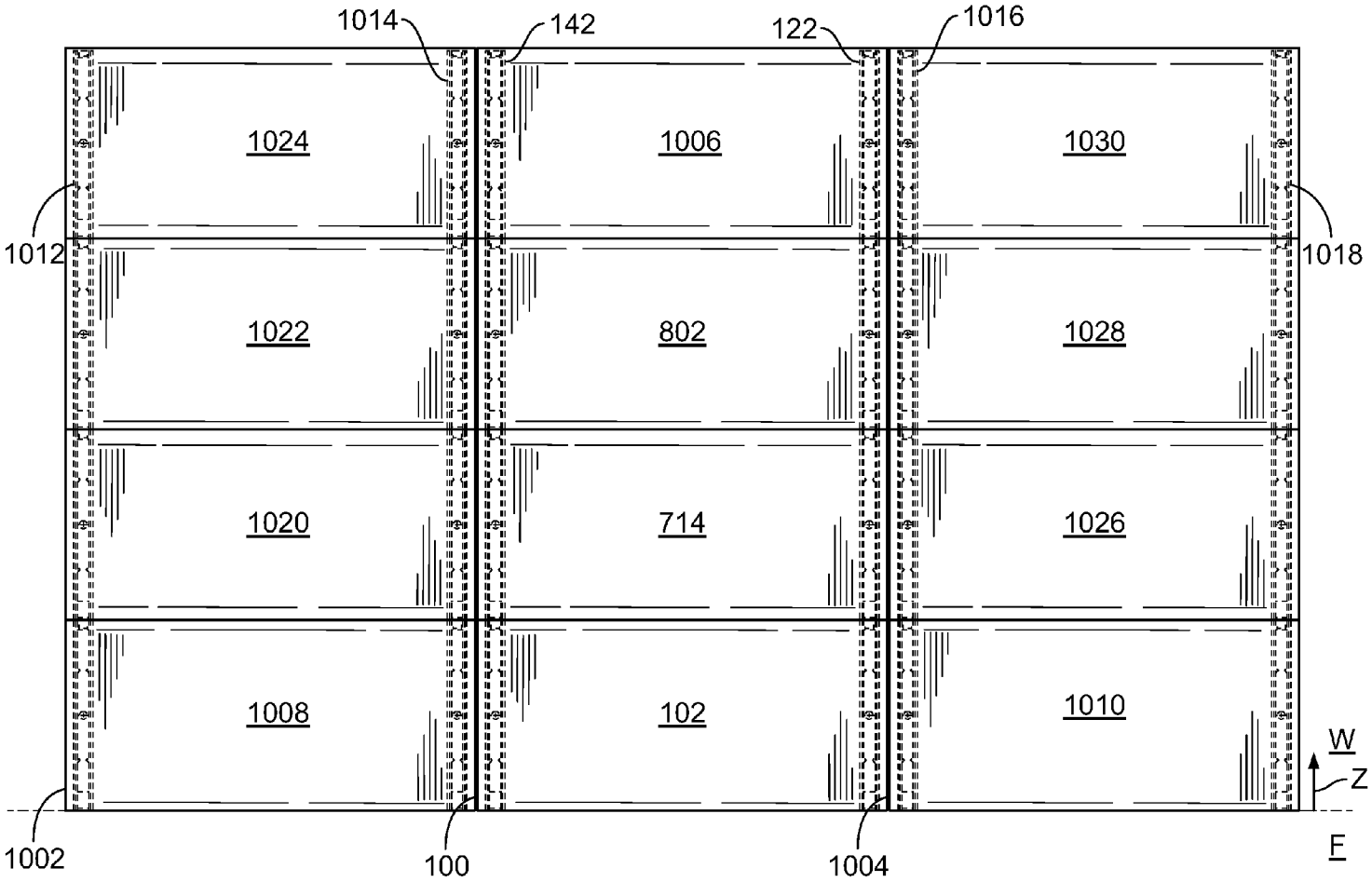
FIG. 10 shows the apparatus shown in FIG. 8 along with other apparatus in accordance with the principles of the invention.

FIG. 10 shows illustrative apparatus 100 side by side with illustrative apparatus 1002 and 1004. Illustrative apparatus 1002 and 1004 may have one or more features in common with illustrative apparatus 100.

Apparatus 1002 and 1004 may be positioned so that panels 1008 and 1010 abut panel 102. The abutment of panels 1008 and 1010 with panel 102 may align standards 1012 and 1014 of apparatus 1002 and standards 1016 and 1018 of apparatus 1004 with standards 122 and 144 of apparatus 100. Two or more of apparatus 100, 1002 and 1004 may be vertically aligned with respect to floor F at any desired value of Z.

Illustrative panel 1006 may be engaged with standards 122 and 142 and may rest on panel 802.

Illustrative panels 1020, 1022 and 1024 may be engaged with standards 1012 and 1014 and may rest on panel 1008.

Illustrative panels 1026, 1028 and 1030 may be engaged with standards 1016 and 1018 and may rest on panel 1008.

Panels 1006, 1020, 1022, 1024, 1026, 1028 and 1030 may have one or more features in common with panel 714. Panels 1006, 1020, 1022, 1024, 1026, 1028 and 1030 may have one or more features in common with panel 102.

The abutment of panels 1008 and 1010 with panel 102 may provide for the horizontal abutment of one or more of panels 1020, 714 and 1026. The abutment of panels 1008 and 1010 with panel 102 may provide for the horizontal abutment of one or more of panels 1022, 802 and 1028. The abutment of panels 1008 and 1010 with panel 102 may provide for the horizontal abutment of one or more of panels 1024, 1006 and 1030.

The vertical alignment of panels 1008 and 1010 with panel 102 may provide for the vertical alignment of one or more of panels 1020, 714 and 1026. The vertical alignment of panels 1008 and 1010 with panel 102 may provide for the vertical alignment of one or more of panels 1022, 802 and 1028. The vertical alignment of panels 1008 and 1010 with panel 102 may provide for the vertical alignment of one or more of panels 1024, 1006 and 1030.

Although FIG. 10 shows three contiguous apparatus, each including four panels, more contiguous apparatus, each including a different number of panels, may be included. Each column of panels, along with an associated set of standards, may be considered a "module." Because an array of panels may include one or more such modules, the apparatus may be referred to as "modular."

Figure 11:
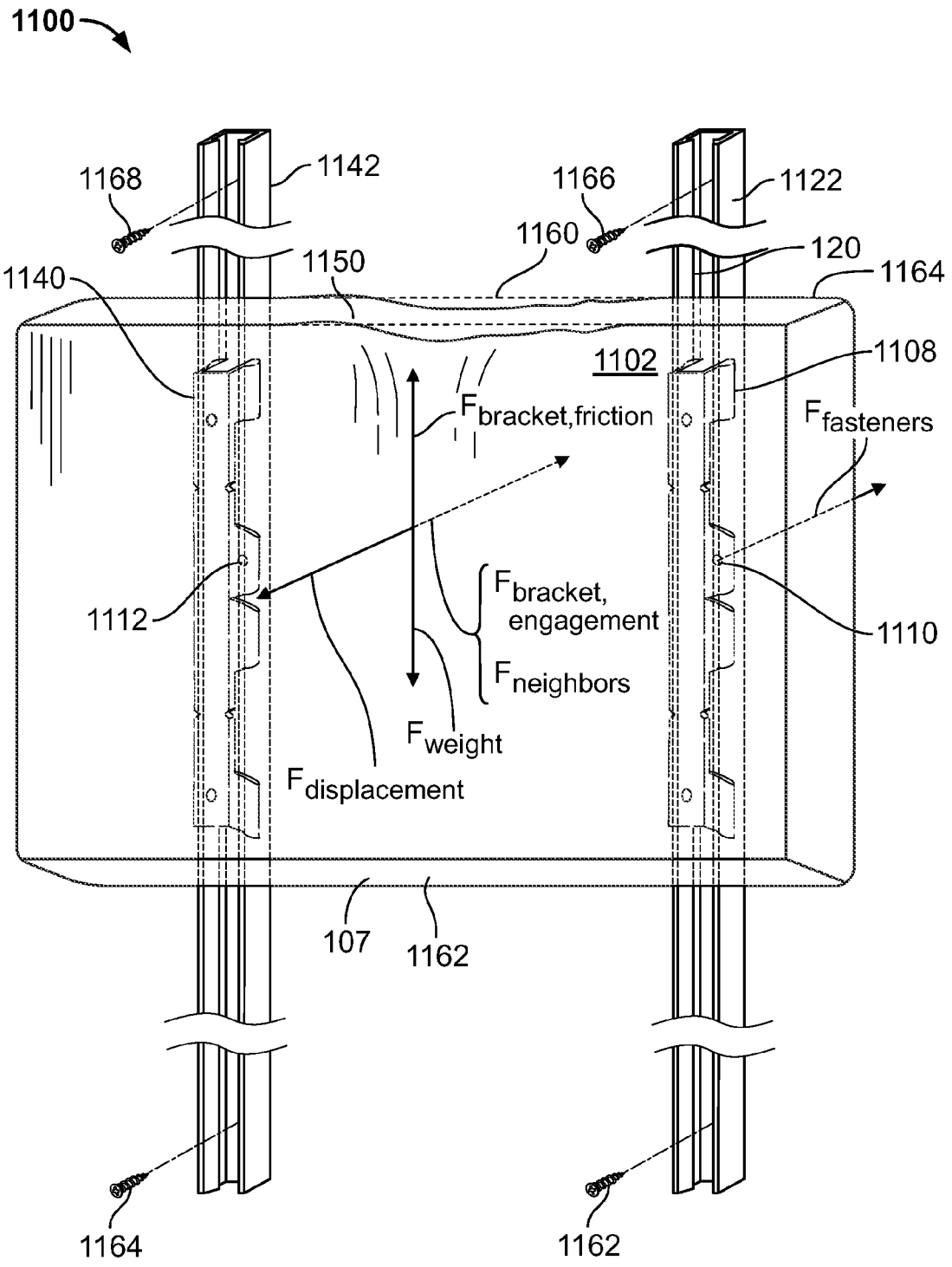
FIG. 11 shows apparatus in accordance with the principles of the invention.

FIG. 11 shows illustrative apparatus 1100. Apparatus 1100 may have one or more features in common with one or more of apparatus 100 (shown in FIG. 1), apparatus 1002 and apparatus 1004 (both shown in FIG. 10). FIG. 11 illustrates relationships between some of the forces that may act or be applied in connection with a wall covering in accordance with the principles of the invention.

Apparatus 1100 may include illustrative panel 1102. Panel 1102 may be slideably engaged with standards 1122 and 1142 by brackets 1108 and 1140, respectively. Panel 1102 may be one of a plurality of panel in apparatus 1100. Fasteners 1110 and 1112 may fasten standards 1122 and 1142 to wall W.

Panel 1102 may be engaged in transverse direction P (shown in FIG. 1) with standards 1122 and 1142. $F_{weight}$, a gravitational body force on panel 1102 may draw panel 1102 downward. $F_{bracket,friction}$, an upward-directed frictional force may resist $F_{weight}$. $F_{weight}$ may be greater than $F_{bracket,friction}$, so panel 1102 may unassistedly slide down standards 1122 and 1142. Interaction between one or both of brackets 1108 and 1140 and standards 1122 and 1142 may contribute to $F_{bracket,friction}$. Interaction between panel 1102 and one or both of standards 1122 and 1142 may contribute to $F_{bracket,friction}$.

Contour 1150, shown in broken line, may be an irregularly shaped edge of panel 1102. When the weight of one or more overlying panels bear down on panel 1102, contour 1150 may resolve into substantially regular or straight contour 1160.

$F_{displacement}$ may act to disengage panel 1102 from one or both of standards 1122 and 1142. $F_{bracket,engagement}$, a force from the engagement of brackets 1108 and 1140, may oppose $F_{displacement}$. $F_{neighbors}$, which may include a frictional force from underlying and overlying panels, may oppose $F_{displacement}$. $F_{neighbors}$ may have a bottom component from bottom edge 1162, which may be in contact with the top of an underlying panel. $F_{neighbors}$ may have a top component from top edge 1164, which may be in contact with the bottom of an overlying panel. The top component may depend on the aggregate weight of overlying panels. The bottom component may depend on the aggregate weight of the overlying panels plus the weight of panel 1102 itself. The top component may depend on a coefficient of friction between the panels. The bottom component may depend on a coefficient of friction between the panels. $F_{neighbors}$ may be include contact forces from interference between edge features (not shown) of the panel.

The gravitational body forces of the different panels may thus stabilize panel 1102 against displacement by a force such as $F_{displacement}$. $F_{displacement}$ may be any displacing force. $F_{displacement}$ may be a user-applied force to disengage panel 1102 from one or both of standards 1122 and 1142.

When a user disengages panel 1102 from one or both of standards 1122 and 1142, the user may apply $F_{displacement}$. $F_{fasteners}$ for the fasteners linking standards 1122 and 1142 may oppose $F_{displacement}$. Each fastener may be linked to wall W with an ultimate tensile capacity. If a force greater than the ultimate tensile capacity is applied to a fastener, the faster may fail and part from the wall. If that happens, one or both of the standards may part from the wall.

One or both of $F_{bracket,engagement}$ and $F_{bracket,neighbors}$ may resist $F_{displacement}$. One or both of the maximum values of $F_{bracket,engagement}$ and $F_{bracket,neighbors}$ (viz., $F_{bracket,engagement|max}$ and $F_{bracket,neighbors|max}$) may be such that the sum of $F_{bracket,engagement|max}$ and $F_{bracket,neighbors|max}$ is less than the combined ultimate tensile capacity of fasteners 1110 and 1112, which correspond to panel 1102. When neighboring fasteners such as 1162, 1164, 1166 and 1168 contribute to $F_{fasteners}$, a greater sum of $F_{bracket,engagement|max}$ and $F_{bracket,neighbors|max}$ may be allowed without causing the standards to part from the wall.

Figure 12:
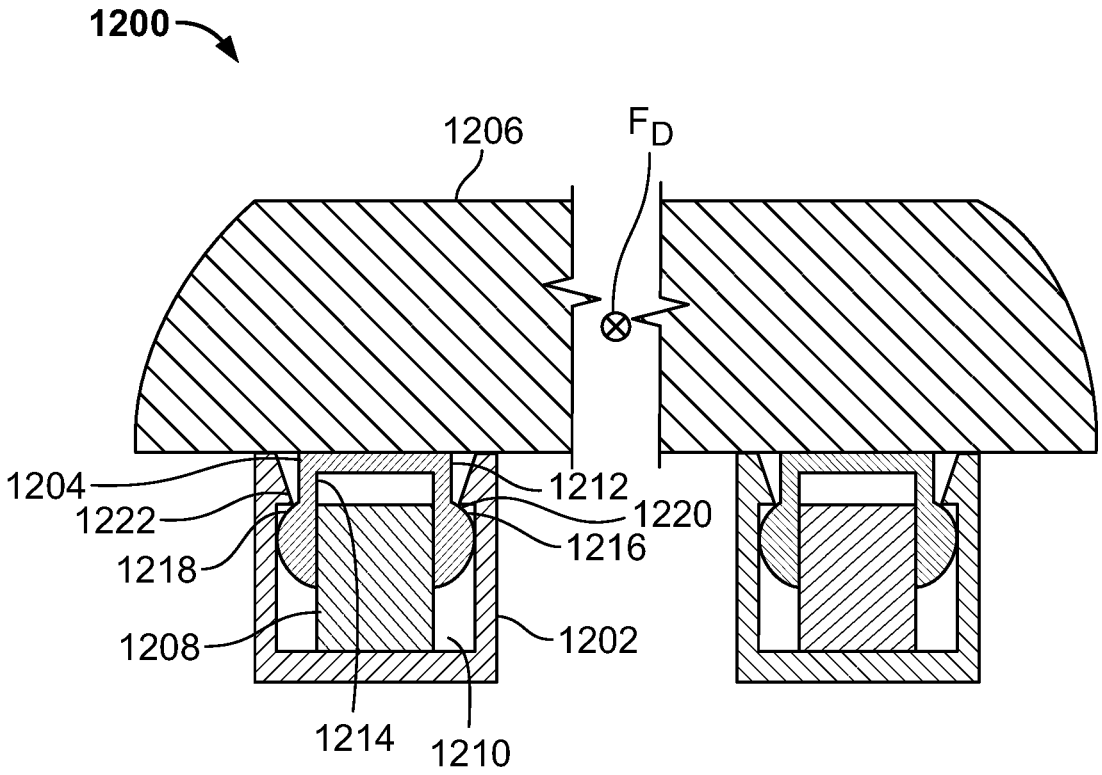
FIG. 12 shows apparatus in accordance with the principles of the invention.

FIG. 12 shows illustrative apparatus 1200. Apparatus 1200 may have one or more features in common with one or more of apparatus 100 (shown in FIG. 1), apparatus 1002 (shown in FIG. 10), apparatus 1004 (shown in FIG. 10) and apparatus 1100 (shown in FIG. 11). Apparatus 1200 may be affixed to a wall (not shown) through a standard such as 1202. Bracket 1204 may slidingly engage standard 1202. Panel 1206 may be attached to bracket 1204. $F_D$, the weight of panel 1206, shown facing into the page, may draw panel 1206 in down direction D (shown in FIG. 1). Brace 1208 may be inserted in channel 1210 of standard 1202. Brace 1208 may prevent projections 1212 and 1214 from deflecting toward each other. This may prevent surfaces 1216 and 1218 from deflecting around bosses 1220 and 1222. Brace 1208 may thus secure bracket 1204 into standard 1202. Brace 1208 may be sized to urge surfaces 1216 and 1218 against standard 1202. This may increase friction between the surfaces and standard 1202. This may increase a force such as $F_{bracket,friction}$ (shown in FIG. 11). This may secure panel 1206 against movement in direction D or –D (shown in FIG. 1).

Brace 1208 may be elongated. Brace 1208 may have a length that spans one or more operational heights of panels such as 1202. Brace 1208 may be insertable along direction D (shown in FIG. 1) in standard 1202. Brace 1208 may be flexible so that brace 1208 can be inserted into the top of standard 1202 and fed down some or all of standard 1202 after the engagement of panels with standard 1202.

Brace 1208 may have a length that is less than or equal to the installed height of panel 1202. Brace 1208 may be transversely inserted into channel 1210 at a location above panel 1202. Brace 1208 may then be displaced in direction D into the illustrated operational position. Each panel may have, for each standard, a brace such as 1208. Each panel may be engaged with the standards, positioned atop a detent (such as 134 and 135, shown in FIG. 1) or an underlying panel, and then secured by a brace such as 1208 before an overlying panel is emplaced. In this manner, the force of overlying panels on underlying panels may be utilized along with the brace.

One or more of the panels may support an electronic device. An electronic device may be provided with one or more brackets for mounting on one or more standards. The electronic device and any packaging may be sized congruent with one or more of the panels so that the electronic device may be mounted contiguous with neighboring panels.

Thus, apparatus and methods for providing wall covering have been provided. Persons skilled in the art will appreciate that the present invention can be practiced by other than the described embodiments, which are presented for purposes of illustration rather than of limitation.

The present invention is limited only by the claims that follow.

What is claimed is:

1. A traveling support for a wall covering panel, the support comprising:

a bracket having a panel mounting surface;

a projection extending from the bracket in a direction away from the panel mounting surface, the projection including a surface that trends away from the direction to define a space in which to receive an elongated standard; and two canted members, separate from each other, that are inclined toward a plane defined by the mounting surface and in operation extend downward from the bracket, the canted members being configured to draw the panel mounting surface toward the elongated standard in response to motion of the bracket along the elongated standard.

2. The support of claim 1 further comprising, when the projection is a first projection, the surface is a first surface, the direction is a first direction and the space is a first space, a second projection extending from the bracket in a second direction away from the panel mounting surface, the second projection including a second surface that trends away from the second direction to define a second space in which to receive the elongated standard.

3. The support of claim 2 wherein the first and second directions converge away from the bracket.

4. The support of claim 2 wherein the first and second directions diverge away from the bracket.

5. The support of claim 2 wherein the first and second surfaces trend toward each other away from the bracket.

6. The support of claim 2 wherein the first and second surfaces trend away from each other away from the bracket.

7. The support of claim 2 wherein the first projection is one of a plurality of first projections, each one of the plurality of first projections extending from the bracket in the first direction and including a surface that is congruent with the first surface.

8. The support of claim 7 wherein the second projection is one of a plurality of second projections, each one of the plurality of second projections extending from the bracket in the second direction and including a surface that is congruent with the second surface.

9. The support of claim 1 further comprising a wall covering panel that is configured to be affixed to the panel mounting surface.

10. Apparatus for covering a wall, the apparatus comprising:

a bracket having a panel mounting surface;

a projection extending from the bracket in a direction away from the panel mounting surface, the projection including a surface that:

trends away from the direction to define a space in which to receive an elongated standard; and includes a face having a tangent that operationally is oriented vertically and is slidable along the standard; and two canted members, separate from each other, that are inclined toward a plane defined by the mounting surface and in operation extend downward from the bracket, the canted members being configured to draw the panel mounting surface toward the elongated standard in response to motion of the bracket along the elongated standard and contact between the canted members and a detent fixed to the elongated standard.

11. The apparatus of claim 10 further comprising, when the projection is a first projection, the surface is a first surface, the direction is a first direction, the space is a first space, and the face is a first face, a second projection extending from the bracket in a second direction away from the panel mounting surface, the second projection including a second surface that trends away from the second direction to define a second space in which to receive the elongated standard and includes a second face having a tangent that operationally is oriented vertically and is slidable along the standard.

12. The apparatus of claim 11 wherein the first and second directions diverge away from the bracket.

13. The apparatus of claim 11 wherein the first and second directions surfaces trend away from each other away from the bracket.

14. The apparatus of claim 11 wherein the first projection is one of a plurality of first projections, each one of the plurality of first projections extending from the bracket in the first direction and including a surface that is congruent with the first surface and a face that is congruent with the first face.

15. The apparatus of claim 14 wherein the second projection is one of a plurality of second projections, each one of the plurality of second projections extending from the bracket in the second direction and including a surface that is congruent with the second surface and a face that is congruent with the second face.

16. The apparatus of claim 10 further comprising a wall covering panel that is configured to be affixed to the panel mounting surface.

17. The apparatus of claim 16 further comprising a video display that is configured to snap into the standard in a position contiguous with the wall covering panel.

18. The apparatus of claim 11 wherein the first and second directions converge away from the bracket.

19. The apparatus of claim 11 wherein the first and second directions diverge away from the bracket.

* * * * *